US007097504B2

(12) United States Patent
Kan

(10) Patent No.: US 7,097,504 B2
(45) Date of Patent: Aug. 29, 2006

(54) SIGNAL CONNECTOR

(76) Inventor: Shin-Nan Kan, No. 209, Sec. 2, Chung Cheng Road, Hu Ko, Hsinchu Shien (TW)

( * ) Notice: Subject to any disclaimer, the term of this patent is extended or adjusted under 35 U.S.C. 154(b) by 0 days.

(21) Appl. No.: 11/025,984

(22) Filed: Jan. 3, 2005

(65) Prior Publication Data

US 2006/0148330 A1 Jul. 6, 2006

(51) Int. Cl.
*H01R 13/648* (2006.01)

(52) U.S. Cl. ..... 439/607; 439/752

(58) Field of Classification Search ..... 439/607, 439/752

See application file for complete search history.

(56) References Cited

U.S. PATENT DOCUMENTS 6,203,353 B1 * 3/2001 Huang et al. ..... 439/352
6,835,092 B1 * 12/2004 Wan et al. ..... 439/541.5

* cited by examiner

*Primary Examiner*—Truc T. Nguyen
(74) *Attorney, Agent, or Firm*—Rosenberg, Klein & Lee

(57) ABSTRACT

The invention relates to a signal connector, which mainly includes a leading structure provided between the shell and the body. The leading structure can expand the opening of the shell with its legs in order to leave from the leg of the body that will facilitate the connection of the body and the shell. Hence, the body can be received in the shell easily and effectively without obstruction.

2 Claims, 4 Drawing Sheets

SIGNAL CONNECTOR

FIELD OF THE INVENTION

The present invention relates to an improvement of a signal connector including a main body and a shell, wherein the main body can be received in the shell easily and effectively.

BACKGROUND OF THE INVENTION

A conventional signal connector always includes a main body received in a metal shell, wherein the body and the shell have extended legs to insert into a PC board for connecting with a signal source and a power source at the same time. Since the legs of the body and the shell are laid in a same plane, they will be difficult and trouble when assembling the shell over the body. The leg of the shell is going to be obstructed by the leg of the main body.

SUMMARY OF THE INVENTION

The present invention is to provide an improved signal connector, wherein the shell can cover on the main body easily to overcome the drawback of prior art. Now, accompanying with the following drawings, the character of the present invention will be described here and after.

DETAILED DESCRIPTION OF THE PREFERRED EMBODIMENT

Figure 1:
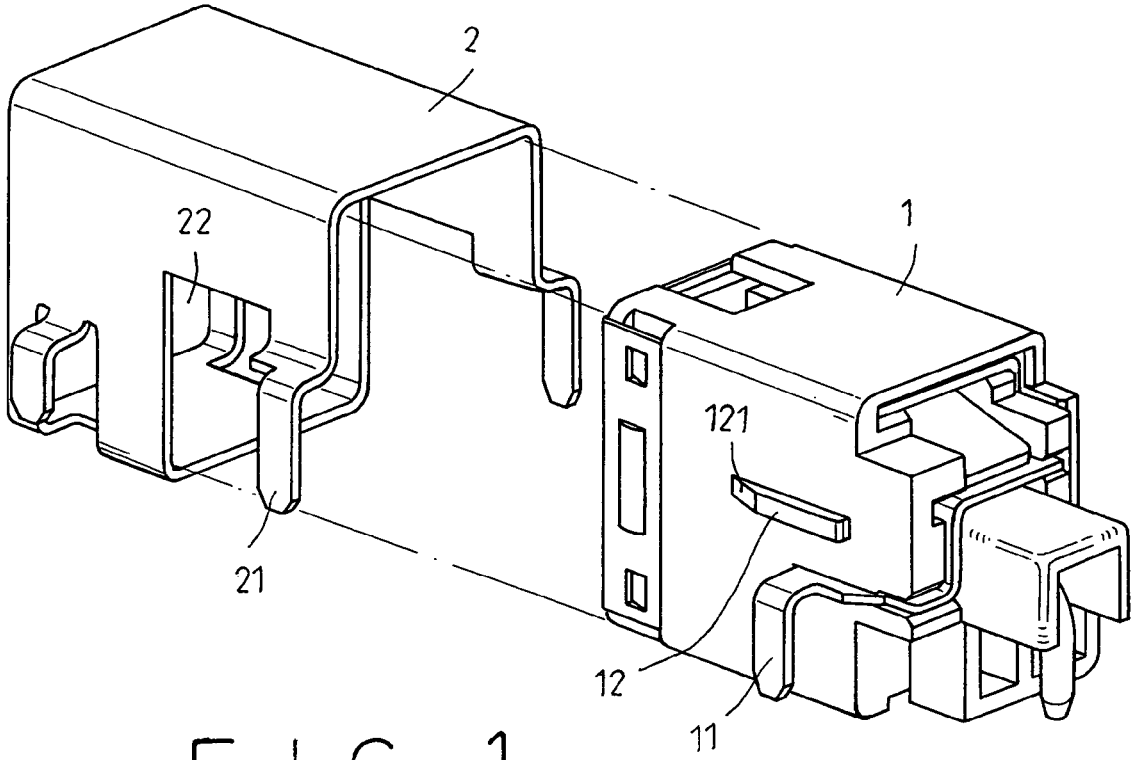
FIG. 1 is an exploded perspective view showing a signal connector according to the present invention.
Figure 2:
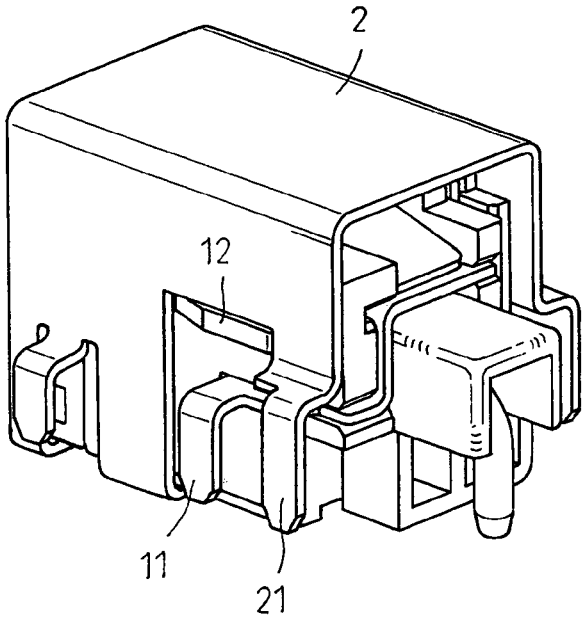
FIG. 2 is an assembled view of FIG. 1.

Please refer to FIGS. 1 and 2, the present invention relates to an improvement of a signal connector, which includes a main body (1) and a metal shell. The body (1) has legs (11) at both sides and the shell (2) has two downward extended legs (21) at front ends as a conventional one. The improvement of the present invention is to provide a leading structure between the shell (2) and the body (1), wherein two convex levels (12) with rear oblique portion (121) are formed on both sides of the body (1) and the shell (2) has its both sides with related gaps (22).

Figure 3:
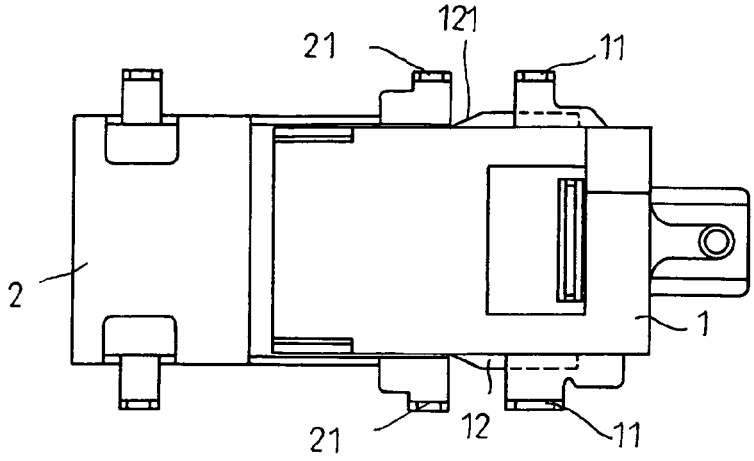
FIGS. 3 to 5 are bottom plan views showing the movements of connection between the shell and the main body according to the present invention.
Figure 4:
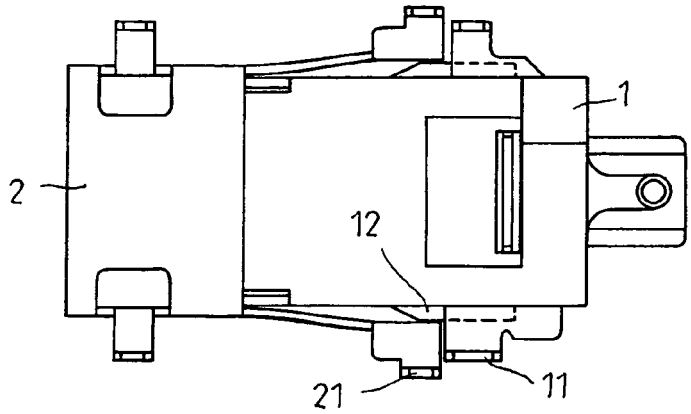
Figure 5:
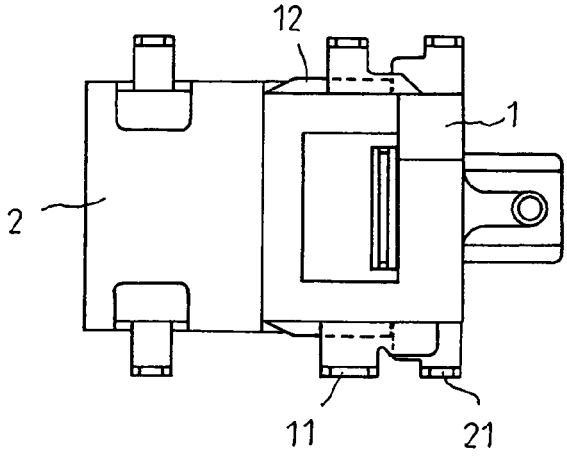

In assembling process, when the shell (2) is moved near to the body (1), the opening of the shell (2) will be expanded as soon as touching the convex level (12) alone the oblique portion (121), from the position of FIG. 3 to FIG. 4. At this time, the leg (21) of the shell (2) can be moved outward to a plane being different from the leg (11) of the body (1). Hence, the shell (2) can be moved to cover the body (1) smoothly without obstruction to the position of FIG. 5 that the body (1) is completely received in the shell (2) and the legs of both are laid at the same plane for inserting into the PC board effectively.

Figure 6:
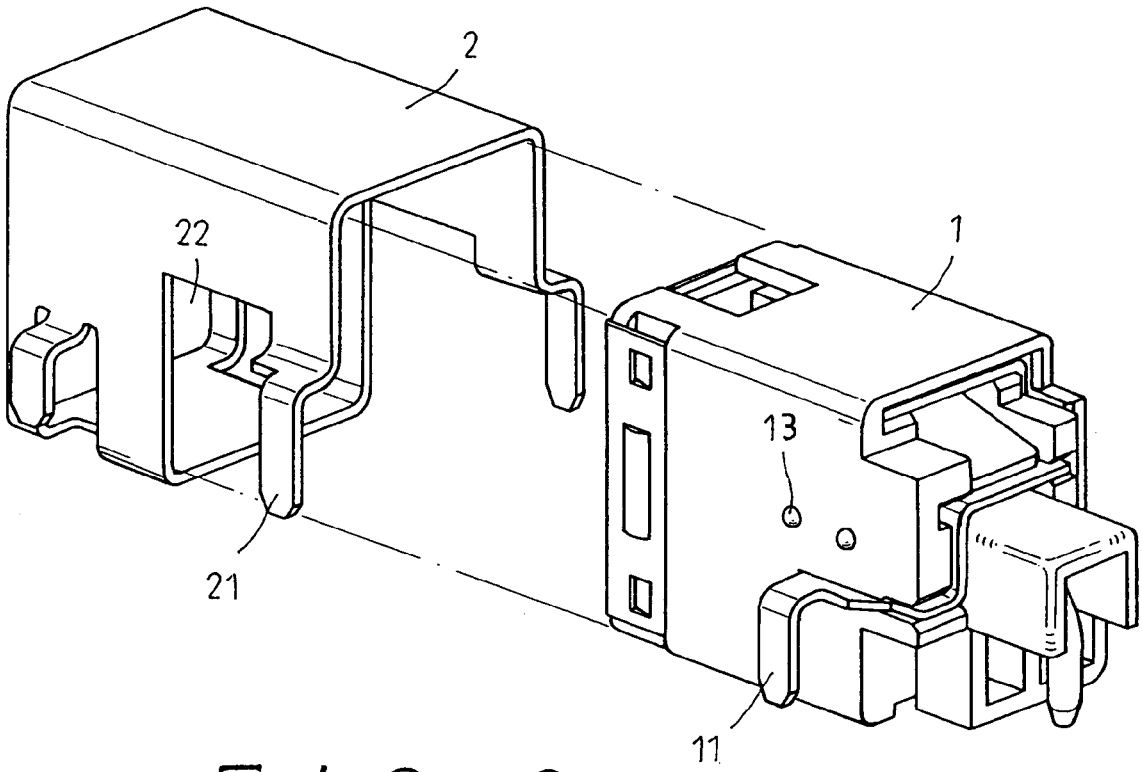
FIG. 6 is an exploded perspective view showing a modified signal connector according to the present invention.
Figure 7:
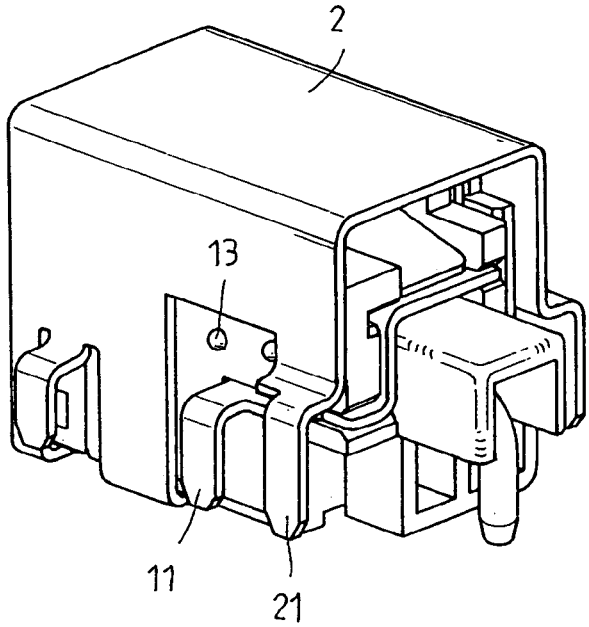
FIG. 7 is an assembled view of FIG. 6.
Figure 8:
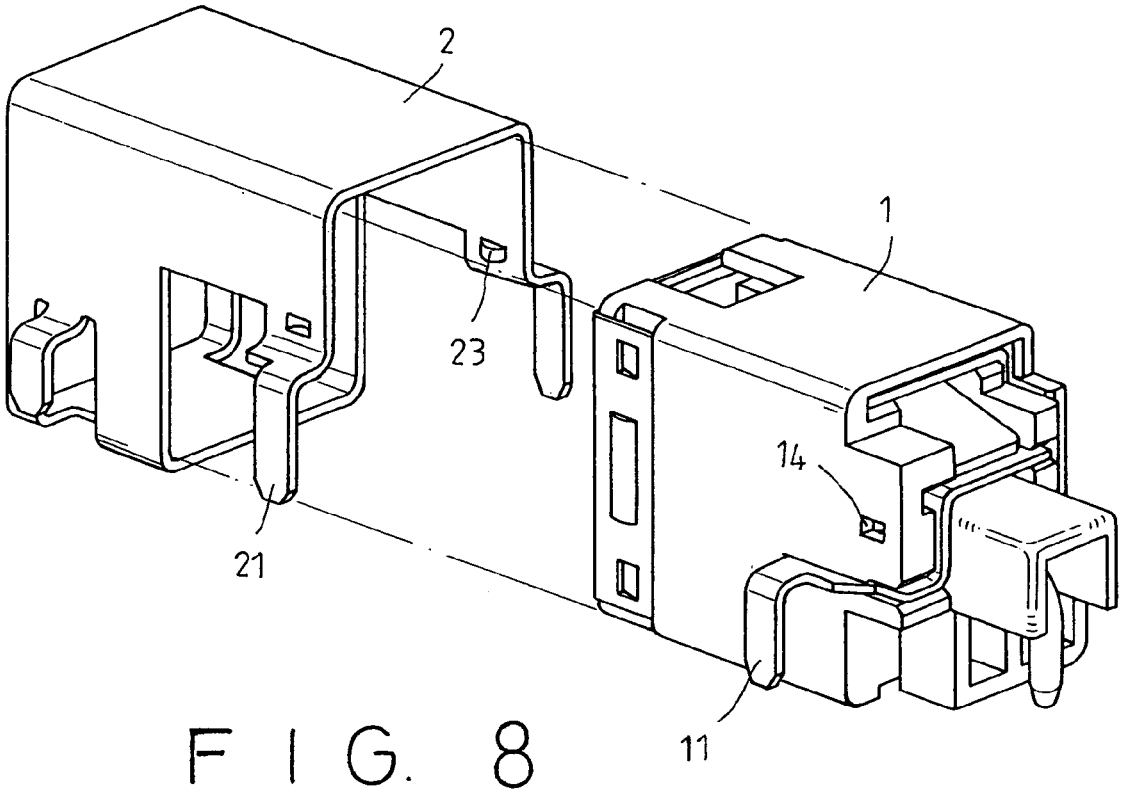
FIG. 8 is an exploded perspective view showing another modified signal connector according to the present invention.
Figure 9:
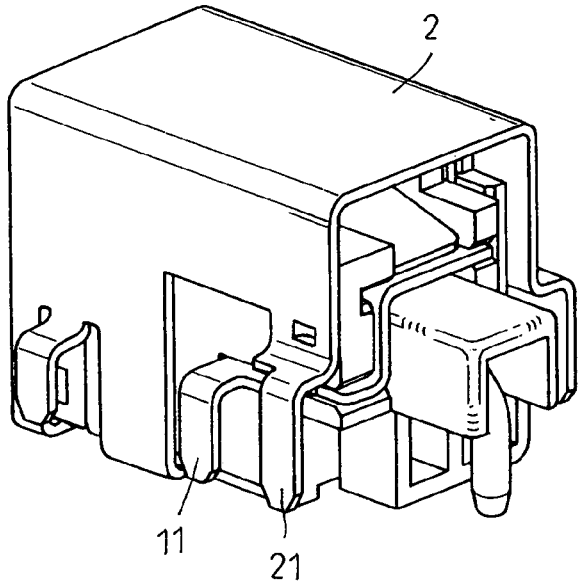
FIG. 9 is an assembled view of FIG. 8.

Accordingly, the body (1) can be received in the shell (2) easily under the invented leading structure of the present invention. It can be understood that the above-mentioned embodiment is only an exemplary and can be modified. Such as shown in FIGS. 6 and 7, the body (1) is provided with two convex spots (13) to replace the convex levels (12) that can obtain a similar effect. In FIGS. 8 and 9, it shows another embodiment of this invention, wherein the shell (2) has inner arched portions (23) for expanding its opening when covering the body and the body (1) has related grooves (14) for receiving the arched portions (23) that the shell (2) is then recovery to the original state for normal use. Any modified embodiment under the same spirit of the present invention will also be claimed in this application.

I claim:

1. A signal connector including a main body and an overlying metal shell, wherein the body has legs at both sides and the shell has two downwardly extending legs on each side of a front end thereof, the legs on each side of the body and the legs on each side of the shell being coplanar; the improvement being a leading structure between the shell and the body, wherein a projection extends from each side of the body having a longitudinally extended level surface portion with a rear oblique portion, the level surface portions being respectively aligned with the legs of the body, the shell having openings formed in the sides thereof rearwardly of the legs of the shell to respectively receive the projections therein, the oblique portion of the projections acting to displace the legs of the shell out of the plane of the legs of the body as the shell is installed on the body and the level surface portion of the projections acting to maintain the out of plane relationship until the legs of the shell pass the legs of the body and the projections are respectively received in the openings.

2. A signal connector including a main body and an overlying metal shell, wherein the body has legs at both sides and the shell has two downwardly extending legs on each side of a front end thereof, the legs on each side of the body and the legs on each side of the shell being coplanar; the improvement being a leading structure between the shell and the body, wherein the leading structure includes a plurality of convex spots formed on each side of the body and the shell having openings formed in the sides thereof rearwardly of the legs of the shell to respectively receive the plurality of convex spots therein, the plurality of convex spots on each side of the body acting to displace the legs of the shell out of the plane of the legs of the body as the shell is installed on the body and maintain the out of plane relationship until the legs of the shell pass the legs of the body and the convex spots are respectively received in the openings.

* * * * *